United States Patent [19]

Keller

[11] 4,191,372

[45] Mar. 4, 1980

[54] TENNIS TRAINER DEVICE

[76] Inventor: Dennis H. Keller, 3437, Witt Rd.

[21] Appl. No.: 889,739

[22] Filed: Mar. 24, 1978

[51] Int. Cl.[2] ..... A63B 69/38

[52] U.S. Cl. ..... 273/29 A; 273/DIG. 30

[58] Field of Search ..... 273/26 E, 29 A, 95 A, 273/184 B, 185 C, 58 C, 200 R, 208, 183 C, 186 B, 197 R, 197 A, 198, DIG. 30, 26 E, 95 A; 24/DIG. 18; 403/109; 546/219

[56] References Cited

U.S. PATENT DOCUMENTS

| | | | |
|---|---|---|---|
| 1,441,221 | 1/1923 | Fourcher | 273/26 E |
| 3,166,317 | 1/1965 | Tumelson | 273/26 E |
| 3,397,885 | 8/1968 | Nash, Jr. | 273/58 C |
| 3,477,717 | 11/1969 | Clark | 273/58 C |
| 3,540,726 | 11/1970 | Davis | 273/26 E |
| 3,893,669 | 7/1975 | Myers | 273/26 E |

FOREIGN PATENT DOCUMENTS

| | | | |
|---|---|---|---|
| 1317990 | 1/1963 | France | 273/95 A |
| 240652 | 6/1925 | United Kingdom | 273/29 A |
| 1023771 | 3/1966 | United Kingdom | 273/95 A |

*Primary Examiner*—Richard C. Pinkham
*Assistant Examiner*—T. Brown
*Attorney, Agent, or Firm*—John E. Wagner

[57] ABSTRACT

A tennis training device for releasably holding a tennis ball at any height appropriate for the practice of serves and ground strokes is disclosed. The apparatus comprises a base and standard for the support of a cross arm from which depends a cord attached by suitable means to a regular tennis ball. A mass member is attached to the cord at a distance above the ball in the described embodiment to prevent the wrapping of the cord about the cross arm when the ball is hit. The mass member is enclosed in an elongated member which is attached along its entire length to the cord, thus further minimizing cord wraps. The fastening means uses a hook material, Velcro or the like, as a means for lightly gripping the ball, but allowing it to release easily when hit so that the trajectory of the ball is not affected by the presence of the fastening means. The cross arm member is manufactured from a single aluminum tube and is angled downward toward its free end so that wraps of cord on the cross arm will tend to fall off. To practice serving, the tennis ball is positioned at a height of about nine feet. After the tennis ball is hit, the fastening means may also be left at a lowered position for the practice of ground strokes.

8 Claims, 10 Drawing Figures

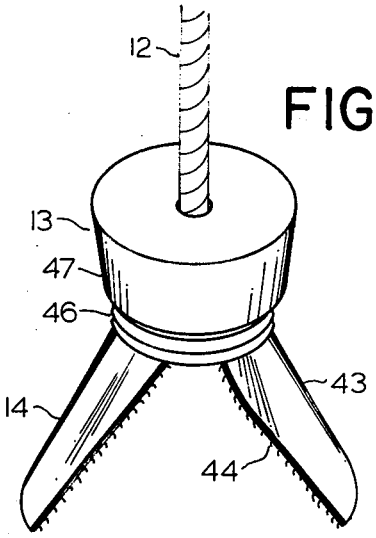
FIG. 5
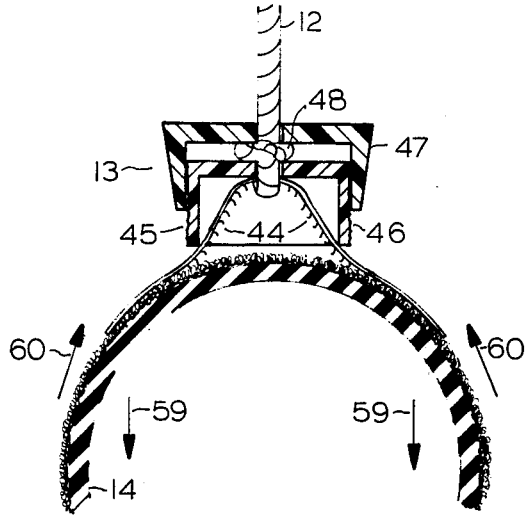
FIG. 6
FIG. 7
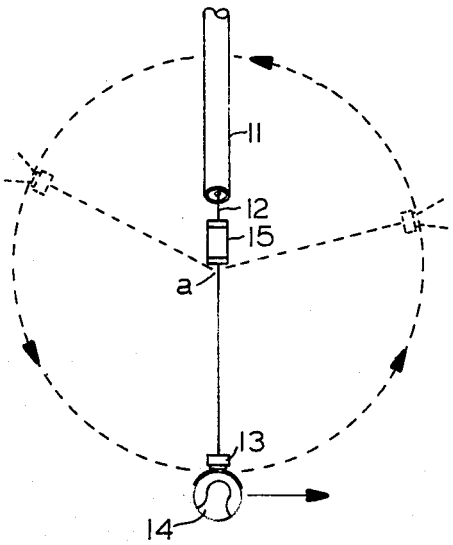
FIG. 8
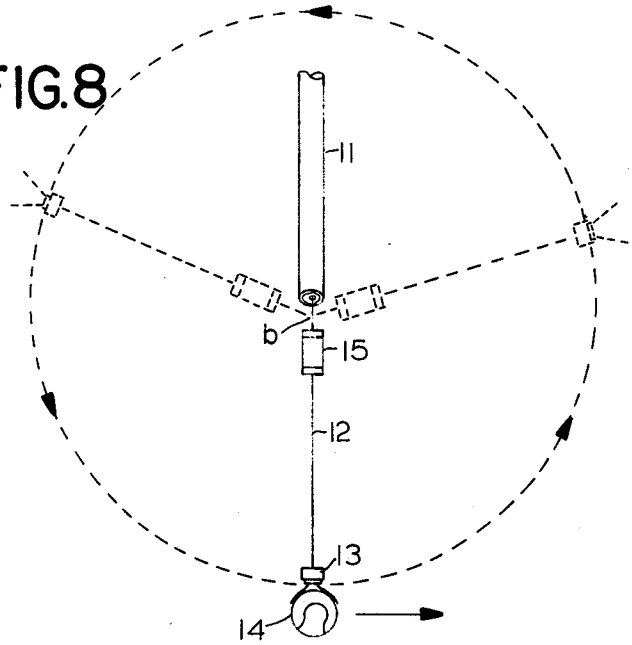
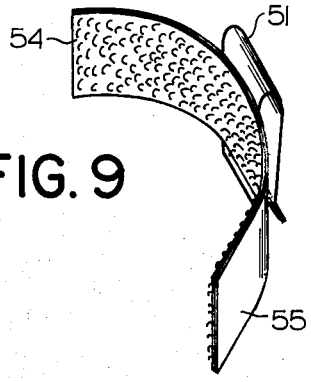
FIG. 9
FIG. 10
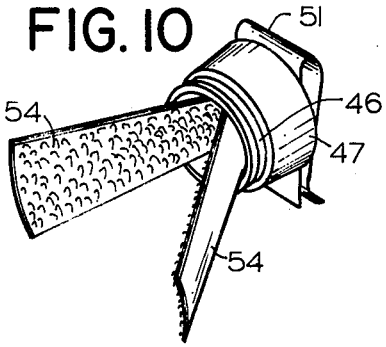

TENNIS TRAINER DEVICE

BACKGROUND OF THE INVENTION

Many sports require the hitting of a ball during play, and therefore much time is spent in the practice of this aspect of said sports. One method of intensive practice is to use a device to hold the ball at the proper height, allowing the player to strike it. Several devices are described in the prior art including U.S. Pat. Nos. 3,166,317, 3,301,556, 3,006,647, and 3,367,655, and typically comprise a ball tethered at the proper height by means of a cord attached to a cross arm of the device. After being struck, the ball will travel in a looping path, finally stopping at its initial location positioned to be struck again.

Such a device could be used in the practice of tennis, but several problems inherent to the practice of tennis tend to diminish the usefulness of these devices. One problem is that accuracy is much more important in tennis than baseball, for instance, so that a person practicing tennis must know exactly where the ball would go if struck. Since the prior art devices have the ball permanently attached to a cord, the player cannot know what the trajectory of the ball would have been. In a tennis trainer, the ball must detach from the fastening means when hit.

A second characteristic of tennis is that the practicing of ground strokes, serves and overhead smashes require that the ball be suspended anywhere from just above ground level to as much as ten feet high. The cross arm must be higher than that, putting it completely out of reach. Therefore, if the cord wraps or tangles on the cross arm, the disentangling of it becomes a time consuming process.

Another problem for a tennis trainer used for serving practice is that the ball holding means is also out of reach. Therefore, some convenient means must be provided for the lowering of the ball holding means between serves so that it can be reloaded.

Further, a device which overcomes the specific problems related to the practice of tennis must still be designed to be manufactured economically in commercial quantities.

Of particular importance in a tennis trainer is the means for connecting the ball to the cord. The ball must be held just well enough to prevent the ball from disengaging before being struck, but the connection must not be so strong that any significant force is exerted on the ball by the cord at the time of impact which would alter its trajectory.

Another frequent requirement in tennis is to hold a second ball when a first ball is in play. It would be a convenience if the means for connecting the ball to the tennis trainer cord could be adapted to be used for temporarily securing a second tennis ball to the belt of the player, allowing hands-free retention of the second ball during play.

I have previously discovered that instruction in another sport, namely volleyball, is greater facilitated by devices which eliminate toss function so the player may concentrate on his own motions without being disturbed by the variations in the toss by oneself or another players. Such teaching devices are disclosed in my patents.

SUMMARY OF THE INVENTION

It is therefore an object of this invention to provide a tennis training device which will hold a tennis ball at any height but will allow the ball to travel freely and naturally when hit by a racquet without any initial restraining force exerted by the device on the ball at the time of impact.

It is a further object of this invention to substantially prevent the cord from wrapping around the cross arm when the ball is struck.

It is a further object of this invention to provide an apparatus for the suspension of a ball of any kind in which the cross arm is designed so that cord loops wrapped around the cross arm after the ball is hit will drop off the cross arm end of its own accord.

It is a further object of this invention to provide said tennis training device in a form that can be manufactured economically.

It is still a further object of this invention to use a hooked material such as Velcro as a means of attaching a tennis ball to the above mentioned tennis training device or to any other surface, such as the clothing of a tennis player during a match to provide for the hands-free holding of a second ball while a first ball is in play.

These and other objects of this invention are achieved in accordance with the teachings herein in a device for the holding of a tennis ball prior to its being hit by a racquet, said device comprising a standard and cross arm from which hangs a cord, the end of the cord having a fastening means loosely attached to the tennis ball. A weight is provided a specific distance above the fastening means to minimize the probability of the cord wrapping around the cross arm. Since the distance between the weight and ball is fixed, the ball height is adjusted by varying the cord length between the weight and cross arm. The weight further comprises an elongated member attached along its length to the cord for stiffening that section of cord, further minimizing the wrapping of cord about the cross arm.

In another embodiment of this invention, the cross arm comprises a single bar member which angles down toward the cord to allow loops of cord, which may become wrapped around said cross arm, to drop off. The cord is conveniently run through the bar member, the free end located proximate the standard where it can be tied off. The standard may also be a tubular member allowing a telescoping interfit of these members.

The fastening means of the above tennis trainer device comprises in one embodiment, a strip of hook material, Velcro or the like, pressed into the cover of the tennis ball. This allows the ball to be held securely, but to be released freely when struck. The adhesion to the ball can be increased by folding the Velcro with the hooks inside and attaching the cord at or near the fold line.

This Velcro strip can also be used to attach a tennis ball to any surface by attaching the material to the surface with the hooks exposed to engage the ball cover. The Velcro can be folded or formed into an arcuate shape to increase the holding power in accordance with my teaching below.

BRIEF DESCRIPTION OF THE DRAWINGS

This invention may be more clearly understood from the following detailed description and by reference to the drawings in which:

FIG. 5 is an isometric view of the ball holder;

FIG. 6 is a sectional side view of the ball holder and tennis ball;

FIG. 7 is a simplified fragmentary end on view of the cross arm, cord ball holder and weight portions of the apparatus showing the path of travel of the ball holder under a light blow to the tennis ball;

FIG. 8 is a view similar to FIG. 7 in which the ball is struck a medium or heavy blow;

FIG. 9 is an isometric view of a ball carrier incorporating hook material; and

FIG. 10 is an isometric view of a ball carrier incorporating the ball holder of this invention.

DETAILED DESCRIPTION OF THE INVENTION

I have found that the learning of tennis, particularly service, is greatly aided if the toss of the tennis ball can be practically separated from the swing. More particularly, the practice of the swing, without the limitations of the toss is a real boon to the instructor. By eliminating the toss, the student may be taught to develop a smooth rythmic swing in the serve. Once having learned to "groove" his swing, the student can show dramatic improvement. After the correct swing is developed with the ball always at the correct height and fore and aft position, the student may then practice the toss, knowing exactly how high he should toss the ball in order for it to be properly struck. This separation of the two steps eliminates the tendency of novice players to attempt to adjust their swinging motion to a continuously moving ball, a highly complex motor coordination factor.

My invention, as described below, facilitates the training progress while using regular balls, on a regular court with the aid adjustable to the correct precise height for each player. It provides informational feedback since the player sees exactly where the ball is hit. He feels no contact with anything except the ball.

Figure 1:
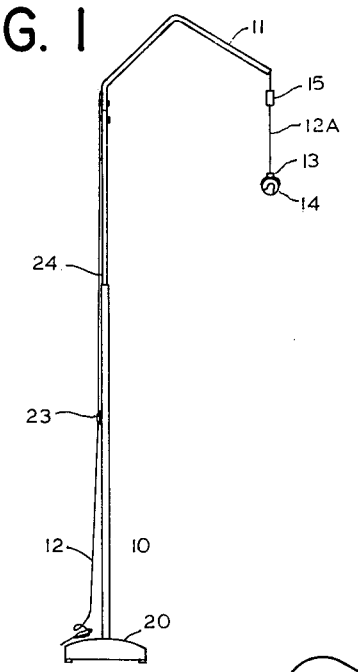
FIG. 1 is an isometric view of the entire apparatus.

Now referring to FIG. 1, the tennis trainer in accordance with this invention may be seen as a vertical standard 10 supporting an angular cross arm 11 through which a cord 12 extends out of the free end of the cross arm 11. The cord 12 carries at its end a ball holder 13 which holds a conventional tennis ball 14. A mass member or weight 15 is secured to the cord 12 between the end of cross arm 11 and the ball holder 13. A length 12A of cord 12 separates the mass member 15 from the ball holder 13.

The ball holder 13, best seen in FIG. 5 includes as its holding surface a length of hook fastener material of the hook and loop type fastening device commonly known by the trademark, Velcro, and disclosed in U.S. Pat. No. 3,009,235.

The standard 10 is supported by a base 20 as described below and shown in FIG. 2. Standard 10 includes a cleat 23 for temporarily securing the cord 12. The cleat 23 may be of the type normally used on small sail boats or other type of hook may be used. This training aid also includes an opening 16 in the cross arm 11 through which the cord emerges and either a pulley 24 or bushing for protecting the cord 12 from chafing as it passes through the opening 16, and for ease of adjustment of height of the ball.

To use this device, a player practicing his serve would first attach a tennis ball 14 to the fastening means 13 by pressing the Velcro hooks into the tennis ball 14 cover. He would then pull the cord 12 through the cross arm 11 and over the roller 24 until the top of the weight 15 is close to the end of the cross arm 11. At this point, the ball should be at the same height it would have been if it had been tossed correctly. Since there are approximately fourteen inches between the weight 15 and the ball 14, the end of the cross arm 11 for an average person would be about ten feet above ground level. If not correct for the individual, it may be adjusted by varying the length of the standard 10, as will be explained in more detail below.

With the ball 14 thus vertically positioned, and with the entire device located at a tennis court base line, the player is now in position to "serve" the ball without going through the motions of a tossing the ball. He may thus practice stance, windup and striking the ball as well as observing its actual flight without concern for the toss.

To reload, the player releases the cord 12 from the lock 23, lowers the ball holder 13, attaches a tennis ball 14, raises the ball holder 13 and locks the cord 12 in place.

The advantages of this device can now be seen, the main one being that the ball 14 is always at the correct height prior to being hit. This is an important factor, especially for beginning players, since they have an erratic toss and usually hit the ball at too low a level. Through the use of this device the player will "groove" his swing to hit the ball 14 at the proper height. Thereafter, he can practice the toss to put the ball 14 at the point where he is accustomed to hitting it. The result is a much more rapid learning of the basic serve motions. Other advantages are the ease of reloading the device, the improbability of the cord 12 becoming wrapped around the cross arm 11 and the economy of manufacture of the parts, each of which will now be discussed.

Figure 2:
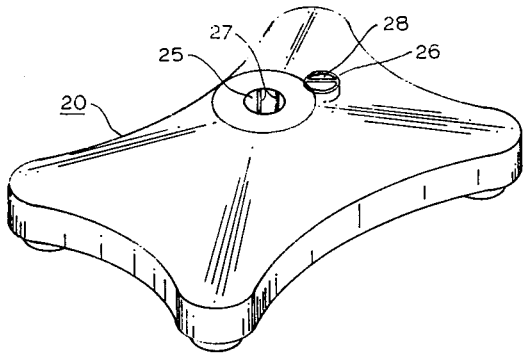
FIG. 2 is an isometric view of a base.

A base 20, as shown in FIG. 2, is generally cruciform in shape with a larger dimension parallel with the cross arm 11, and includes a central mounting hole 25 in which the standard 10 is inserted. In the preferred embodiment of FIG. 2, the base 20 is slightly elongated at the corners for more stability, is raised at the center to provide a longer mounting hole 25 and a more rigid connection to the standard 10, and can be filled with water or sand through the fill hole 26 to give the base 20 greater stability and weight. The hole 26 is then closed with a tight fitting stopper 28. The mounting hole 25 is molded with four integral raised contact ridges 27, two of which appear in FIG. 2, to securely contact the enclosed standard 10. The base, preferably of blow molded plastic, is stable, easily filled and emptied and easily transported and stored.

Figure 3:
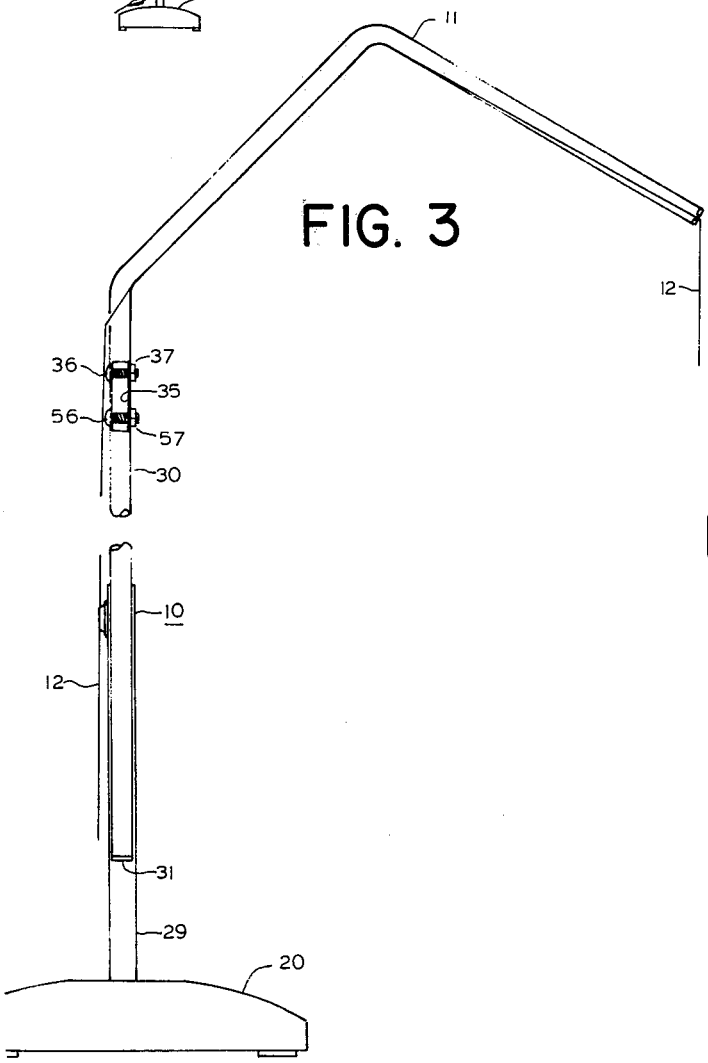
FIG. 3 is a cross sectional side view of the standard and cross arm.

Now referring to FIG. 3, the standard 10 is made from two telescoping aluminum tubes, a lower tube 29 of greater diameter and an upper tube 30 of smaller diameter. The apparatus is adjusted for height by raising or lowering the upper tube 30 and then locking it in place with a cam lock 31.

The cam lock 31 preferred is described in U.S. Pat. No. 3,095,418 to Balzer, and in an improvement U.S. Pat. No. 3,515,418 to Nielsen. In accordance with the well known use of such cam locks, to change the height of the standard 10, the upper tube 30 is rotated for example, clockwise to unlock it, positioned to a new height, and rotated counter-clockwise to lock it at the new height.

Once the height of the cross bar 11 is set, the holder 13 is repetitively lowered for loading and then raised into its "serve" position. To make this more convenient, the cord locking device 23 of FIG. 1, of the quick release marine type is provided on the standard 10. A simple cleat of the type used on small sailboats is sufficient. Using this device, the ball holder 13 can be raised and lowered by the cord 12 quickly and conveniently.

The cross arm 11, as shown in FIG. 3, is another aluminum tube equal in diameter to that of the upper tube 30. A tight-fitting sleeve 35 is connected to the cross arm 11 by means of a bolt 36 and a nut 37. The attachment of these parts, then, simply consists of sliding the sleeve 35 into the upper tube 30. It can then be retained there by a second bolt 56 and a nut 57.

The remainder of the cross arm 11 is bent into the shape shown in FIG. 3. This shape is convenient in that it places as much of the cross arm 11 as possible out of the loops of cord 12 that might form on the cross arm 11 after the area traversed by the racket and is further protection against cord hangup.

Figure 4:
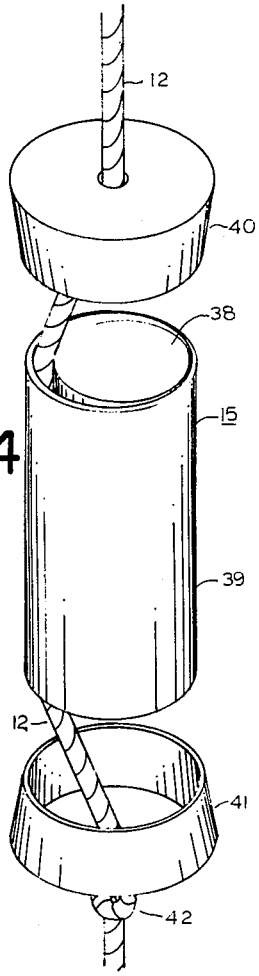
FIG. 4 is an exploded view of the weight.

As shown in FIG. 1, a weight 15 is attached to the cord 12. This weight 15 is shown in detail in FIG. 4. The weight 15 comprises a central core 38 made from any dense material such as an iron bar, and a cover 39 with top 40 and bottom 41 caps. In the described embodiment, the cover 39 is an aluminum tube and the caps 40, 41 are plastic. To assemble this weight 15, a knot 42 is tied in the cord 12 at the desired height, and the bottom cap 41 is located against it. The core 38 and cover 39 are inserted in the cap 41, the top cap 40 is put on, and the excess cord 12, if any, is pulled out from the top 40. The total length of the weight 15 in the described embodiment is approximately three and one-half inches and the weight is about six ounces or at least 3/4 of the combined weight of the weight 15, cord 12A and ball holder 13.

The effect of the mass or weight member 15 in play is illustrated in FIGS. 7 and 8. Depending upon the force applied to the ball, the cord 12, holder 13 and weight 15 will transcribe paths somewhat as illustrated in FIGS. 7 and 8 for low or great force. The dashed lines denote the basic paths of the tennis ball holder 13 and cord 12.

Note in FIG. 7 that the mass 15 remains relatively fixed and the lower length of cord 12 holder 13 describe an arc about Point A, the bottom of the mass 15. When this occurs no tangling of the cord on the cross arm can occur since the free length of cord 12 usually does not contact the cross arm 11 let alone wind up on it.

In FIG. 8, the mass is also moved but moves about Point B, the upper end of weight 15 in a circular path. Since the weight 15 stiffens the cord for an appreciable distance, e.g. 4 inches, the cord has extreme difficulty in starting to windup on the cross arm 11 if the weight is up against the end of the cross arm 11. If the weight is lowered as in ground stroke practice, Point B is so far from the cross arm that windup is virtually impossible.

The ball 14 is held by a holder 13 which is shown in an isometric view in FIG. 5 and in section in FIG. 6. As shown in these figures, the Velcro strip 43 is folded in half with the hooks 44 inside, and tied at the fold line by the cord 12. The strip 43 is then pulled into an inner cap 46 and the cord is knotted at knot 48 to restrain the Velcro strip 43 in its folded position. Finally, an outer cap 47 is secured over the knot 48 to the inner cap 46 with glue 45 to complete the device. In use, the tennis ball cover 58 is pressed onto the hooks 44, thus securing the ball 14 to the holder 13. As shown in FIG. 6, the weight of the ball produces a downward force as shown by arrows 59 while the hook material 54 transmits force longitudinally, as shown by arrows 60 due to the jaw-like action of the cap 46. The result is that the separating forces are substantially in shear rather than in tension, greatly enhancing the holding power of this ball holder 13.

This hook material is on efficient means of releasably securing a tennis ball to any surface and may be used, for instance, by a player as a tennis ball carrier while the first ball is in play, a frequent requirement in tennis. For this purpose, in one typical embodiment, as shown in FIGS. 9 and 10, a hook material 54 may be formed into an arcuate or jaw-like shape for greater gripping force, and mounted on a belt 53 by means of any suitable clips 51 or the like. This arcuate shape may be maintained by backing the hook material 54 with a backing member 55 of any kind that will flexible retain its shape, such as polyethylene plastic or spring steel, or by a restraining member such as cups 46 and 47 of FIG. 10. The Velcro used in each application has a stiff back and is known as hook and loop fastener SJ3520 of the Minneapolis Mining and Manufacturing Company of Minneapolis, Minnesota.

When the Velcro used in holder 13 is only about one inch in width and approximately one inch in length in each jaw for use with a regulation tennis ball, the holder 13 grasps only the upper part of the ball. It is believed that the tennis racquet strings in meeting with the ball never contact the holder 13 in any noticable way because the force of the tennis ball drives the holder 13 and cord 12 away from the tennis racquet. Thus, a natural simulation of an actual tossed ball and release exists when using this invention. The above described embodiments of the invention are merely descriptive of its principles and are not to be considered limiting. The scope of this invention instead shall be determined from the scope of the following claims, including their equivalents.

What is claimed is:

1. A sport training device to improve a player's ability to hit a ball comprising:

a substantially vertical standard;

a cross arm, one end connected to said standard in an elevated position;

a cord, one end of said cord being suspended from the other end of said cross arm;

fastening means attached to the other end of said cord and releasably attaching a ball to the other end of said cord a said ball being released upon impact of said ball by a striking implement; and a weight attached to said cord and spaced from said fastening means sufficiently such that blows to the said ball will not normally strike said weight, and whereby said weight tends to prevent the wrapping of said cord about said cross arm after impact of said ball by a striking implement;

said weight constituting at least three/quarters of the combined weight of said length of cord suspended from said cross arm, said fastening means and said weight whereby, upon the striking of a ball attached to said fastening means, the length of cord between said weight and said fastening means after impact of said ball by a striking implement tend to describe an arcuate path with said weight remaining relatively stationary and preventing wrap-up of said cord about said cross arm.

2. The apparatus of claim 1 wherein said cord is adjustably secured to said standard and extensible whereby the height at which said ball is held is varied by varying the length of cord between said weight and said cross arm.

3. The apparatus of claim 1 wherein said weight further comprises a stiffening member of significant length attached along a length of said cord for preventing the flexing of said cord at the line of attachment, thus minimizing the wrapping of said cord around said cross arm after the ball is hit.

4. A sport training device to improve a player's ability to hit a ball comprising:

a substantially vertical standard;

a cross arm, one end connected to the top of said standard and the other end thereof being free;

a cord, one end supported from the free end of said cross arm, the other to a ball;

a relatively rigid elongated weight means attached along and intermediate the ends of said cord and having a weight substantially greater than the suspended portion of said cord, a substantial length of said cord including said relatively rigid weight mean will resist winding up about said cross arm upon impact of a said ball by a striking implement;

wherein said cross arm comprises a single bar member, a portion thereof closer to said free end being angled downwards to allow loops of cord which may become wrapped around said cross arm to drop off after a said ball is hit by a striking implement; and wherein said weight means has a weight of at least three-fourths of the combined weight of said card, said attachment means and said weight means.

5. The apparatus of claim 4 wherein said cross arm comprises a tubular bent member and wherein said cord runs through said tubular member, and said one end of said cord thus being located proximate to said standard.

6. The apparatus of claim 5 wherein said standard comprises a tubular member of greater diameter than said cross arm, allowing a telescoping interfit of said standard and said cross arm.

7. A tennis training device for use in training to hit a standard lawn tennis ball comprising:

a substantially vertical standard;

a cross arm having one end connected to the top of said standard and the other end thereof being free;

a cord, one end susupended from said free end of said cross arm;

a hook material strip for releasably holding a tennis ball to said cord, the hooks of said strip being pressed into a said tennis ball cover to allow the tennis ball to be suspended until a said tennis ball is hit by a striking implement, and thereupon to release a said tennis ball with a minimum of attachment overcoming force; and a weight attached to said cord intermediate said strip and said free end of said cross arm at a predetermined distance from said strip such that said weight will tend to prevent the wrapping of said cord about said cross arm after impact of a said tennis ball by a striking implement; and wherein said cross arm comprises a single bar member, a portion thereof closer to said free end being angled downwards to allow loops of cord which may become wrapped around said cross arm to drop off after a said tennis ball is hit by a striking implement; and wherein said weight has a weight of at least three-fourths of the combined weight of said cord, said strip and said weight 8. A sport training device to improve a player's ability to hit a ball comprising:

a substantially vertical standard;

a cross arm, one end attached to an elevated portion of said standard;

a cord, one end of said cord connected to the other end of said cross arm;

fastening means attached to the other end of said cord and releasably attaching a ball to said cord, a said ball being released upon impact; of said ball by a striking implement; and an elongated stiffening member attached to a length of said cord at a distance above said fastening means for decreasing the tendency of said cord to wrap around said cross arm after said ball is hit;

wherein said elongated stiffening member comprises a member having a weight of at least three/quarters of the total weight of the cord, the fastening means and said elongated stiffening member.

* * * * *